US011397045B2

(12) United States Patent
Hwang et al.

(10) Patent No.: US 11,397,045 B2
(45) Date of Patent: Jul. 26, 2022

(54) REFRIGERATOR

(71) Applicant: SAMSUNG ELECTRONICS CO., LTD., Suwon-si (KR)

(72) Inventors: Inyong Hwang, Suwon-si (KR); Byungsu Kim, Suwon-si (KR); Sanghyeok Park, Suwon-si (KR); Sangjoon Im, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/119,159

(22) Filed: Dec. 11, 2020

(65) Prior Publication Data

US 2021/0180854 A1 Jun. 17, 2021

(30) Foreign Application Priority Data

Dec. 13, 2019 (KR) ..... 10-2019-0167273

(51) Int. Cl.
*F25D 25/02* (2006.01)
*F25D 23/06* (2006.01)

(52) U.S. Cl.
CPC ..... *F25D 25/02* (2013.01); *F25D 23/067* (2013.01); *F25D 2325/00* (2013.01); *F25D 2500/02* (2013.01)

(58) Field of Classification Search
CPC ..... F25D 23/065; F25D 23/067; F25D 25/02; F25D 25/024; F25D 2323/06; F25D 2325/00; F25D 2500/02
See application file for complete search history.

(56) References Cited

U.S. PATENT DOCUMENTS 5,893,620 A * 4/1999 Birgelis ..... F25D 25/024 312/408
2019/0360742 A1* 11/2019 Wantland ..... F25D 23/067

FOREIGN PATENT DOCUMENTS

| | | | | |
|---|---|---|---|---|
| CN | 106766633 A * | 5/2017 | | |
| DE | 102012222857 A1 * | 6/2014 | ..... | F25D 23/067 |
| EP | 0582780 A1 * | 2/1994 | ..... | F25D 25/02 |
| EP | 1929224 | 11/2019 | | |
| JP | 11-132649 | 5/1999 | | |
| JP | 2008-39263 A | 2/2008 | | |
| KR | 20-1987-0015218 U | 10/1987 | | |
| KR | 0120643 Y1 | 2/1997 | | |

(Continued)

OTHER PUBLICATIONS

International Search Report dated Mar. 16, 2021 in International Patent Application No. PCT/KR2020/017995.

*Primary Examiner* — Andrew M Roersma
(74) *Attorney, Agent, or Firm* — Staas & Halsey LLP

(57) ABSTRACT

Provided is a refrigerator including a supporting projection to reduce noise created from a rack. The refrigerator includes an outer case, an inner case arranged inside the outer case to define a storeroom, a rack removably arranged in the storeroom, a projection protruding from a side of the inner case, on which to put a side end of the rack, and at least one side supporting projection forming a separation space between the side of the inner case and a side of the rack to prevent the side of the rack from contacting the side of the inner case, wherein the side supporting projection includes a rack contact portion arranged between the side of the rack and the side of the inner case and formed into a curved plane to reduce an area of contact with the side of the rack.

18 Claims, 11 Drawing Sheets

(56) References Cited

FOREIGN PATENT DOCUMENTS

| | | | | |
|---|---|---|---|---|
| KR | 20-1998-013820 | | | 6/1998 |
| KR | 1998-060560 | U | | 11/1998 |
| KR | 1999-002767 | U | | 1/1999 |
| KR | 20-1999-0020579 | | | 6/1999 |
| KR | 20-0167098 | | | 2/2000 |
| KR | 10-0534476 | | | 12/2005 |
| KR | 1020080029045 | A | * | 4/2008 |
| KR | 1020080040972 | A | * | 5/2008 |
| KR | 10-2009-0121030 | | | 11/2009 |
| KR | 10-1269760 | | | 5/2013 |
| KR | 10-2018-0007772 | A | | 1/2018 |

* cited by examiner

REFRIGERATOR

This application is based on and claims priority under 35 U. S. C. § 119 to Korean Patent Application No. 10-2019-0167273 filed on Dec. 13, 2019, in the Korean Intellectual Property Office, the disclosure of which is incorporated herein by reference in its entirety.

BACKGROUND

1. Field

The disclosure relates to a refrigerator, and more particularly, to a refrigerator having a support projection to reduce noise created from racks.

2. Discussion of Related Art

Refrigerators are devices having a storeroom and a cold air supply for supplying cold air into the storeroom to keep groceries fresh.

Temperatures in the storeroom remain within a certain range required to keep the groceries fresh.

The storeroom has an open front, which is closed by a door at ordinary times to maintain the temperature of the storeroom.

The storeroom is partitioned by a wall into a freezer chamber and a fridge chamber, the freezer and fridge chambers being opened or closed by the respective doors.

There are racks installed in the fridge and freezer chambers to divide and separate the fridge and freezer chambers into a plurality of spaces.

The racks are removably installed, possibly having separation spaces to the side of the fridge or freezer chamber. The fridge and freezer chambers may tremble because of contraction due to cooling, vibrations from door opening or closed, vibrations from operation of the cold air supply, and the trembling may cause the racks to collide with the inside of the fridge and freezer chambers and make noise.

Furthermore, when the rack, the side of which is not supported, may be moved within the separation space formed between the rack and the side of the fridge or freezer chamber, the trembling of the fridge and freezer chambers may make the racks out of position.

SUMMARY

In accordance with an aspect of the disclosure, a refrigerator includes an outer case, an inner case arranged inside the outer case to define a storeroom, a rack removably arranged in the storeroom, a projection protruding from a side of the inner case, on which to put a side end of the rack, and at least one side supporting projection forming a separation space between the side of the inner case and a side of the rack to prevent the side of the rack from contacting the side of the inner case, wherein the side supporting projection includes a rack contact portion arranged between the side of the rack and the side of the inner case and formed into a curved plane to reduce an area of contact with the side of the rack.

The refrigerator may further include a bottom supporting projection formed at the projection to form a separation space between the projection and a bottom side of the rack to prevent contact between the bottom side of the rack and the projection.

The bottom supporting projection may include a rack contact portion arranged between the bottom side of the rack and the projection and formed into a curved plane to reduce an area of contact with the bottom side of the rack.

The side supporting projection may be formed on the side of the inner case, the bottom supporting projection may be formed on the projection, and the side supporting projection and the bottom supporting projection may be integrally formed.

The refrigerator may further include an auxiliary supporting projection formed on the projection to support the bottom side of the rack and arranged in front of the bottom supporting projection.

the side supporting projection may be formed to be tilted toward a front of the storeroom such that an end of the side supporting projection is closest to the front of the storeroom, and the side supporting projection may be formed to be tilted toward a rear side of the storeroom such that an end of the side supporting projection is closest to the rear side of the storeroom.

the projection and the side supporting projection may be integrally formed with the inner case, and the bottom supporting projection may be integrally formed with the projection.

The projection may include a first projection arranged on a left side of the inner case, on which to put a left end of the rack, and a second projection arranged on a right side of the inner case, on which to put a right end of the rack at a height corresponding to the first projection, and the side supporting projection may include a first side supporting projection formed on the left side of the inner case, and a second side supporting projection formed on the right side of the inner case at a height corresponding to the first side supporting projection.

The first side supporting projection and the second side supporting projection may be arranged to face each other.

The refrigerator may further include a first bottom supporting projection formed at the first projection to form a separation space between the first projection and the bottom side of the rack to prevent contact between the bottom side of the rack and the first projection, and a second bottom supporting projection formed at the second projection to form a separation space between the second projection and the bottom side of the rack to prevent contact between the bottom side of the rack and the second projection.

The first side supporting projection and the first bottom supporting projection may be integrally formed, and the second side supporting projection and the second bottom supporting projection may be integrally formed.

One of the first side supporting projection and the second side supporting projection may be arranged near a front of the inner case, and the other one may be arranged near a rear side of the inner case.

The refrigerator may further include a first bottom supporting projection formed at the first projection to form a separation space between the first projection and the bottom side of the rack to prevent contact between the bottom side of the rack and the first projection, and a second bottom supporting projection formed at the second projection to form a separation space between the second projection and the bottom side of the rack to prevent contact between the bottom side of the rack and the second projection.

The first side supporting projection and the first bottom supporting projection may be integrally formed, and the second side supporting projection and the second bottom supporting projection may be integrally formed.

In accordance with another aspect of the disclosure, a refrigerator includes an outer case; an inner case arranged inside the outer case to define a storeroom; a rack removably arranged in the storeroom; a first projection formed on a left side of the inner case to allow the rack to be put on the first projection, and having a plurality of bottom supporting projections arranged to contact a bottom side of the rack; a second projection formed on a right side of the inner case, and having a plurality of bottom supporting projections arranged to contact the bottom side of the rack; a first side supporting projection formed on the left side of the inner case to come into contact with a left side of the rack put on the first projection, and having a curved plane to reduce an area of contact with the rack; and a second side supporting projection formed on the right side of the inner case to come into contact with a right side of the rack put on the second projection, and having a curved plane to reduce an area of contact with the rack.

One of the first side supporting projection and the second side supporting projection may be arranged near a front of the inner case, and the other one may be arranged near a rear side of the inner case.

The refrigerator may further include a third side supporting projection formed on the left side of the inner case, and a fourth side supporting projection formed on the right side of the inner case, and the third side supporting projection may be arranged to face the second side supporting projection, and the fourth side supporting projection may be arranged to face the first side supporting projection.

The plurality of bottom supporting projections may be connected to and formed integrally with the plurality of side supporting projections, respectively.

In accordance with another aspect of the disclosure, a refrigerator includes an outer case; an inner case arranged inside the outer case to define a storeroom; a rack removably arranged in the storeroom; a plurality of projections formed to protrude from an inner side of the inner case for the rack to be arranged in the storeroom; and a supporting projection formed on an edge of each of the plurality of projections to support a side end of the rack, wherein the supporting projection includes a first rack contact portion contacting a side of the rack and formed into a curved plane to reduce an area of contact with the side of the rack, and a second rack contact portion contacting a bottom side of the rack and formed into a curved plane to reduce an area of contact with the bottom side of the rack.

The supporting projection may be formed by integrally connecting a side supporting projection having the first rack contact portion arranged, and connected to the inner case, to a bottom supporting projection having the second rack contact portion arranged, and connected to the projection case are integrally connected.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
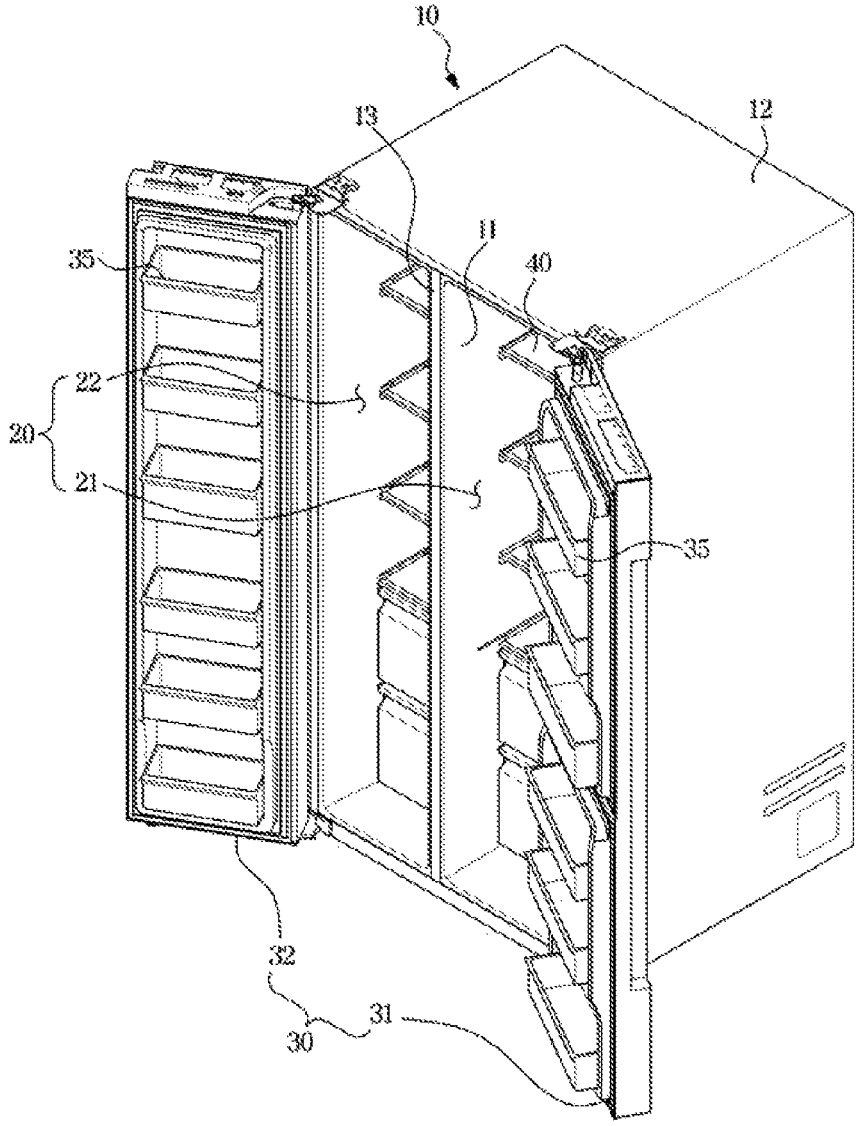
FIG. 1 is a perspective view of a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components. For the sake of clarity, the elements of the drawings are drawn with exaggerated forms and sizes.

The terminology used herein is for the purpose of describing particular embodiments only and is not intended to limit the present disclosure. It is to be understood that the singular forms "a," "'an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments of the disclosure, which are illustrated in the accompanying drawings, wherein like reference numerals refer to the like elements throughout.

The disclosure provides a refrigerator having an enhanced rack supporting structure to reduce noise created from collision between a rack and an inner case.

The disclosure also provides a refrigerator having an enhanced rack supporting structure to minimize an extent to which the rack is out of position.

Figure 2:
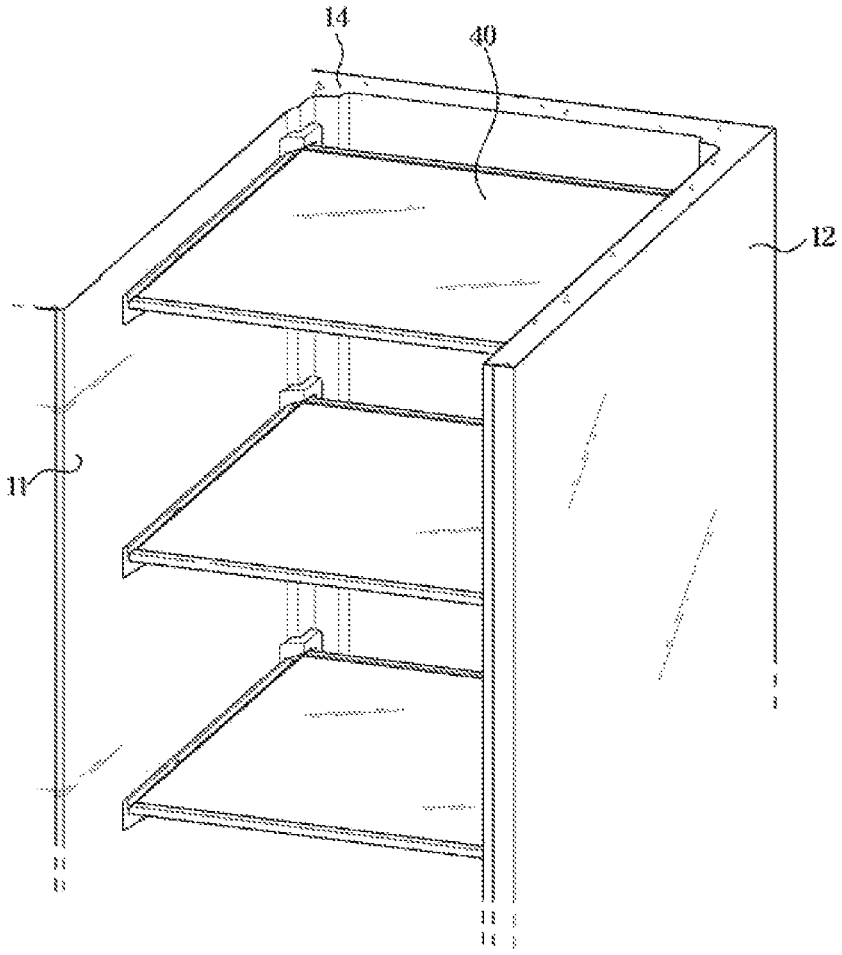
FIG. 2 shows racks arranged in the refrigerator shown in FIG. 1.
Figure 3:
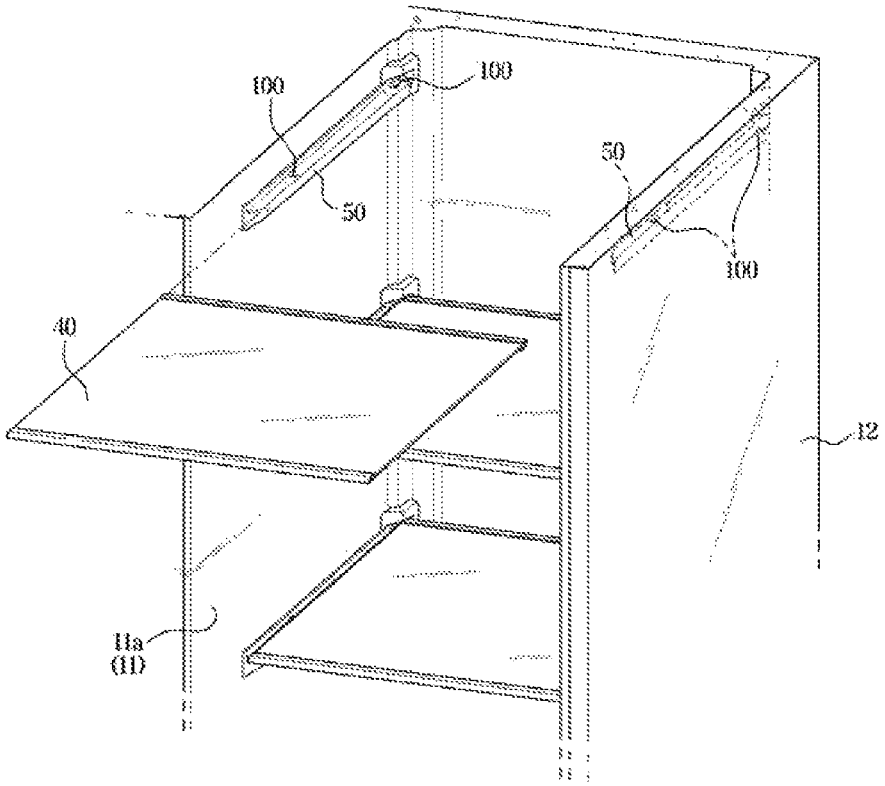
FIG. 3 shows a rack removed from a fridge chamber of the refrigerator of FIG. 1.
Figure 4:
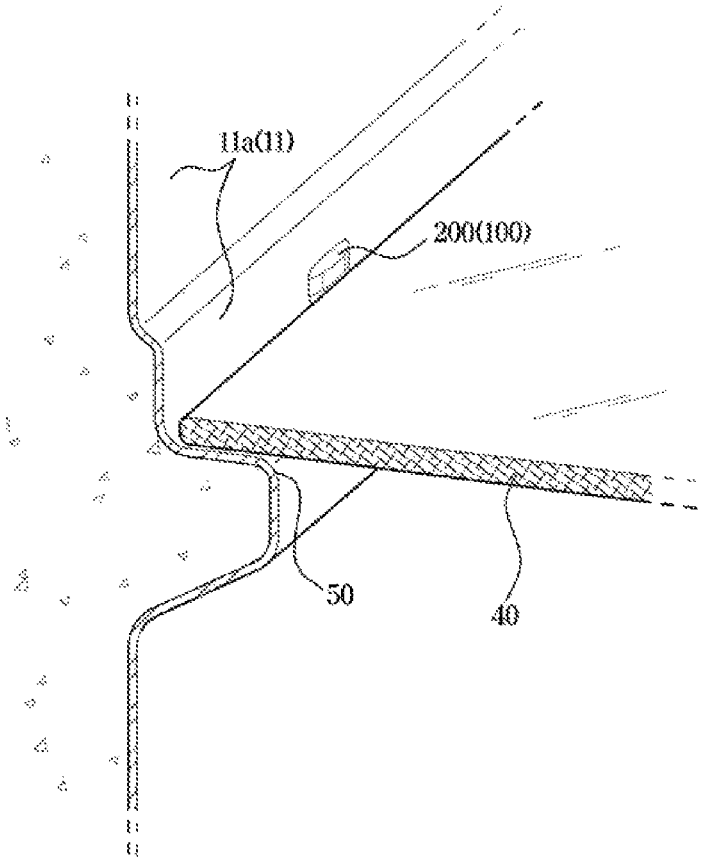
FIG. 4 shows a state in which a rack arranged in the refrigerator shown in FIG. 1 is supported by a supporting projection.

FIG. 1 is a perspective view of a refrigerator, according to an embodiment of the disclosure. FIG. 2 shows racks arranged in the refrigerator shown in FIG. 1. FIG. 3 shows a rack removed from a fridge chamber of the refrigerator of FIG. 1. FIG. 4 shows a state in which a rack arranged in the refrigerator shown in FIG. 1 is supported by a supporting projection.

Referring to FIGS. 1 to 4, a refrigerator may include a main body 10, a storeroom 20 with the front open, which is provided inside the main body 10, and a door 30 rotationally coupled to the main body 10 to open or close the open front of the storeroom 20.

The main body 10 may include an inner case 11 defining the storeroom 20, an outer case 12 defining the exterior, and a cold air supply (not shown) for supplying cold air to the storeroom 20.

The cold air supply may include a compressor, a condenser, an expansion valve, an evaporator, a fan, a cold air duct, etc., and insulation 14 is foamed between the inner case 11 and the outer case 12 of the main body 10 to prevent a leak in the cold air.

The storeroom 20 is divided by a partition wall 13 into a fridge chamber 21 and a freezer chamber 22. The fridge chamber 21 and the freezer chamber 22 may be opened or closed by a fridge door 31 and a freezer door 32, respectively, which are rotationally coupled to the main body 10, and a plurality of door guards 35 may be installed on the rear sides of the door 30 to contain foods.

There may be a plurality of racks 40 provided in the storeroom 20, which may divide the fridge chamber 21 and freezer chamber 22 into a plurality of spaces.

The rack 40 may be removably mounted on a projection 50 formed at the storeroom 20. Specifically, the projection 50 may be integrally formed with the inner case 11. The projection 50 may be formed from a protruding portion of the inner case 11.

A plurality of supporting projections 100 including side supporting projections 200 to support the rack 40 may be formed on the inner case 11.

The following description will be focused on the fridge chamber 21, which, however, may be equally applied to the freezer chamber 22.

The fridge chamber 21 may be shaped like a cuboid, inner surfaces of which are defined by a top plane, a bottom plane, a left side plane, a right side plane, and a rear plane, which are portions of the inner case 11, and which has an open front that may be opened or closed by the door 30.

The projections 50 may be formed in the plural on each of a left side 11*a* and a right side of the fridge chamber 21. The projections 50 may make pairs, each pair having one on the left side and the other on the right side of the fridge chamber 21. That is, multiple pairs of projections 50 may be provided on the left and right sides of the fridge chamber 21. The projection 50 may refer to a portion protruding horizontally from the side of the fridge chamber 21 or a portion integrally formed with the inside of the fridge chamber 21.

The following description will be focused on the projection 50 formed on the left side 11*a* of the fridge chamber 21, so the side (or side plane) of the inner case or the fridge chamber 21 may refer to the left side 11*a* of the fridge chamber 21 and the side of the rack 40 may refer to the left side of the rack 40.

The description focused on the projection 50 formed on the left side 11*a* of the fridge chamber 21 may be equally applied to the projection 50 formed on the right side of the fridge 21, in which case the side (or side plane) of the fridge chamber 21 may refer to the right side of the fridge chamber 21 and the side of the rack 40 may refer to the right side of the rack 40.

The rack 40 may be formed of glass, and may be removably positioned in the fridge chamber 21. Specifically, the rack 40 may be put inside the fridge chamber 21 through the open front, and placed in position between the top plane and bottom plane of the fridge chamber 21 with left and right ends of the rack 40 supported by a pair of projections 50.

On the side 11*a* of the fridge chamber 21, a side supporting projection 200 may be formed to support the side of the rack 40 when the rack 40 is put on the projection 50. The side supporting projection 200 may be formed at a higher level than the projection 50. The side supporting projection 200 may be located between the side of the rack 40 and the side 11*a* of the storeroom. The side supporting projection 200 may be formed from a protruding portion of the inner case 11. That is, the side supporting projection 200 may be integrally formed with the inner case 11.

Figure 5:
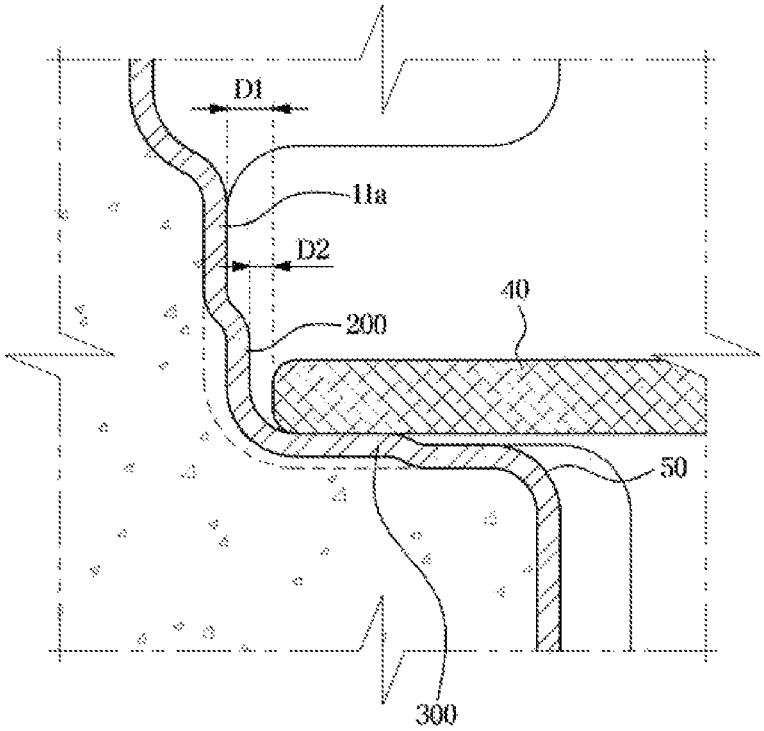
FIG. 5 is a cross-sectional view of the supporting projection shown in FIG. 4.
Figure 6:
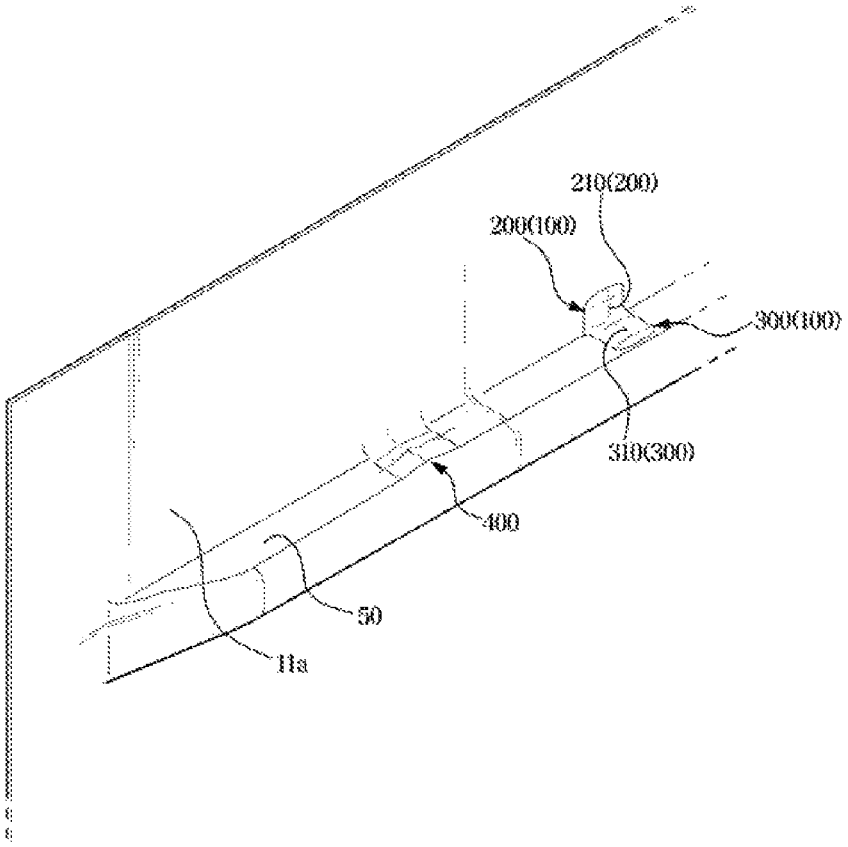
FIG. 6 shows a projection and a supporting projection of the refrigerator shown in FIG. 1.

FIG. 5 is a cross-sectional view of the supporting projection shown in FIG. 4. FIG. 6 shows a projection and a supporting projection of the refrigerator shown in FIG. 1.

Referring to FIGS. 5 and 6, the side supporting projection 200 may include a rack contact portion 210 to come into contact with the side of the rack 40 to support the side of the rack 40. Specifically, the rack contact portion 210 may have the shape of a three dimensional (3D) curved plane swollen toward the side of the rack 40 from the side 11*a* of the storeroom 20. As compared to a flattened form, the curved form of the rack contact portion 210 may reduce an area of contact with the rack 40. The rack contact portion 210 may make point contact or line contact with the side of the flattened rack 40. In other words, when a plane parallel to the rear side of fridge chamber 21 and a plane parallel to the bottom side of the fridge chamber 21 meet the curved rack contact portion 210, one or two curves may be formed.

The side supporting projection 200 may form a separation space to prevent contact between the side of the rack 40 and the side of the fridge chamber 21, and the side of the rack 40 may be separated from the side 11*a* of the fridge chamber 21 by separation space D1.

Because of contraction of the fridge chamber 21 due to cooling, deformation of the fridge chamber 21 due to a change in pressure in the fridge chamber 21 when the door is opened or closed, vibrations from impact when the door is opened or closed, vibrations from operation of the cold air supply, etc., the side 11*a* of the fridge chamber 21 and the side of the rack 40 may tremble in a direction of approaching each other, and may collide with each other. In this case, the side supporting projection 200 may make the side of the rack 40 collide with the rack contact portion 210 instead of the side 11*a* of the fridge chamber 21, thereby minimizing an area of contact and noise from the collision.

Furthermore, a movable distance D2 in the presence of the side supporting projection 200, that the rack 40 may be moved to the left and right due to trembling, may be smaller than the movable distance D1 without presence of the side supporting projection 200. This may minimize an extent to which the rack 40 is out of position due to trembling of the fridge member 21 or rack 40.

At the projection 50, a bottom supporting projection 300 may be formed to support the bottom side of the rack 40 when the rack 40 is put on the projection 50. The bottom supporting projection 300 may be located between the bottom side of the rack 40 and the projection 50. The bottom supporting projection 300 may be formed from a protruding portion of the inner case 11 which forms the projection 50.

Specifically, the bottom supporting projection 300 may be integrally formed with the projection 50 and the inner case 11.

The bottom side supporting projection 300 may include a rack contact portion 310 to come into contact with the bottom side of the rack 40 to support the bottom side of the rack 40. Specifically, the rack contact portion 310 may have the shape of a 3D curved plane swollen toward the bottom side of the rack 40 from the projection 50. As compared to a flattened form, the curved form of the rack contact portion 310 may reduce an area of contact with the rack 40. The rack contact portion 310 may make point contact or line contact with the bottom side of the flattened rack 40. In other words, when a plane parallel to the rear side of fridge chamber 21 and a plane parallel to the side of the fridge chamber 21 meet the curved rack contact portion 310, one or two curves may be formed.

The bottom supporting projection 300 may form a separation space to prevent the bottom side of the rack 40 from contacting the projection 50.

Accordingly, even when the rack 40 trembles vertically due to vibrations or shocks on the refrigerator, the bottom supporting projection 300 may make the bottom side of the rack 40 collide with the rack contact portion 310 instead of the projection 50, thereby minimizing an area of contact and noise from the collision.

The side supporting projection 200 may be integrally formed with the bottom supporting projection 300. The side supporting projection 200 may be formed on the side 11*a* of the fridge chamber 21 while the bottom supporting projection 300 may be formed on the projection 50, and the side supporting projection 200 and the bottom supporting projection 300 may be connected together at an edge where the side of the fridge chamber 21 and the projection 50 join, thereby being provided integrally. The side 11*a* of the fridge chamber 21 and the projection 50 are perpendicular to each other, so the side supporting projection 200 and the bottom supporting projection 300 may be connected at a right angle. The supporting projection 100 may refer to an integral form of the side supporting projection 200 and the bottom supporting projection 300.

As the side supporting projection 200 and the bottom supporting projection 300 are integrally provided, the side supporting projection 200 and the bottom supporting projection 300 may be simultaneously formed in a single molding process, leading to easy production.

However, the embodiment of the disclosure is not limited thereto. For example, the side supporting projection 200 and the bottom supporting projection 300 may be formed separately. That is, the side supporting projection 200 and the bottom supporting projection 300 may not be connected. Accordingly, the bottom supporting projection 300 may or may not be placed on a plane parallel to the rear side of the fridge chamber 21 and including the side supporting projection 200.

Figure 7:
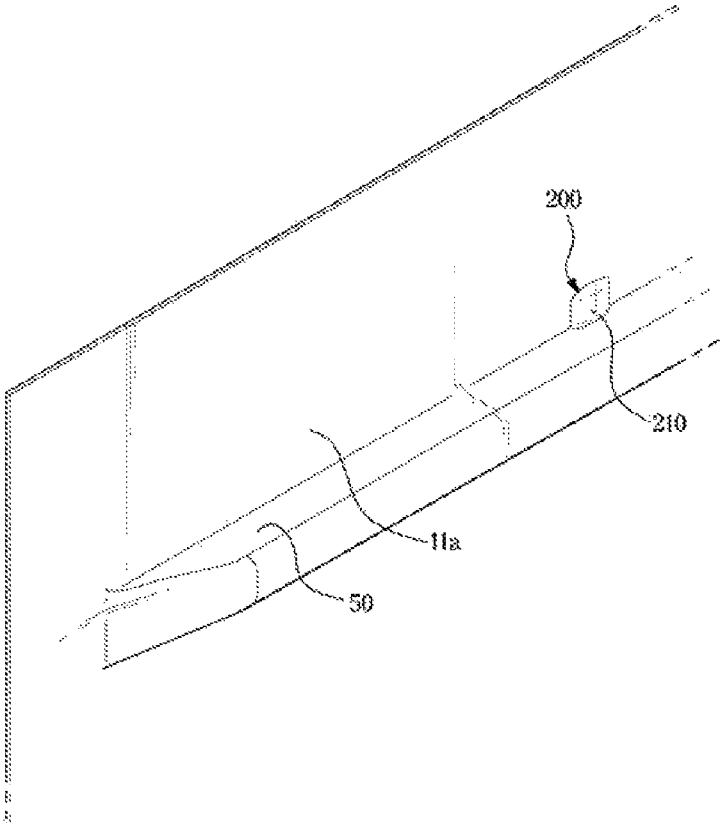
FIG. 7 shows a projection and a side supporting projection of a refrigerator, according to another embodiment of the disclosure.
Figure 8:
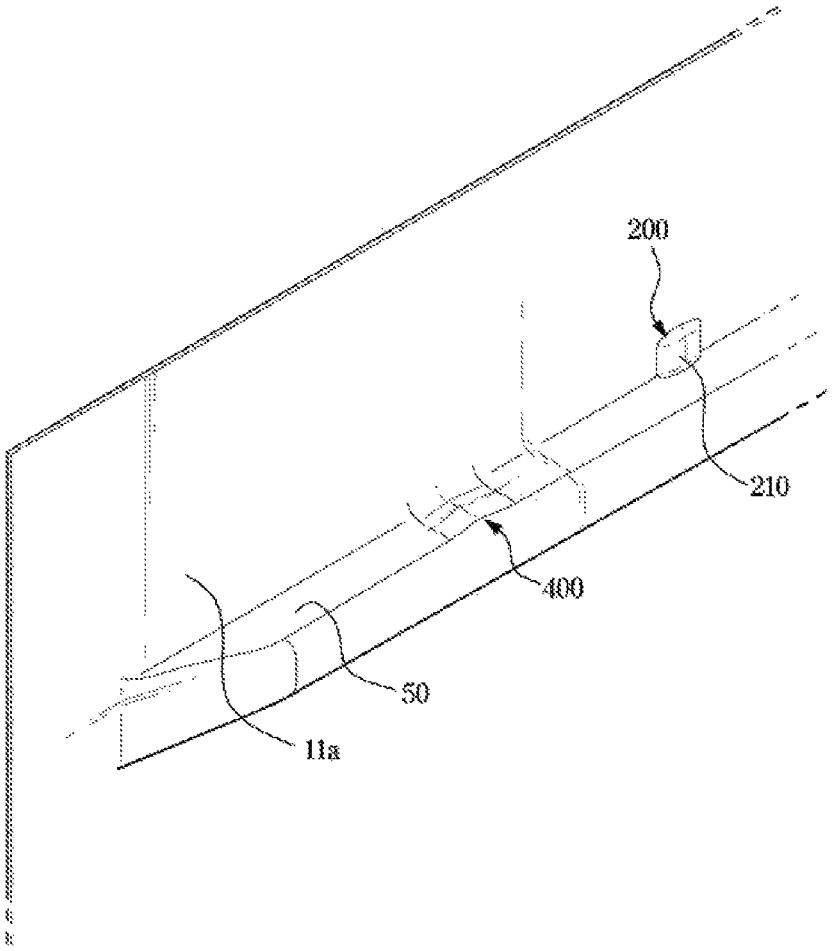
FIG. 8 shows a projection and a side supporting projection of a refrigerator, according to another embodiment of the disclosure.

There may be another example as follows. FIG. 7 shows a projection and a side supporting projection of a refrigerator, according to another embodiment of the disclosure. FIG. 8 shows a projection and a side supporting projection of a refrigerator, according to another embodiment of the disclosure.

Referring to FIG. 7, only the side supporting projection 200 may be formed at the fridge chamber 21. Hence, the side of the rack 40 may be supported by the side supporting projection 200, and the bottom side of the rack 40 may directly contact the projection 50.

Alternatively, as shown in FIG. 8, the side supporting projection 200 may be formed on the side 11*a* of the fridge chamber 21 and an auxiliary supporting projection 400 may be formed on the projection 50, so that the side of the rack 40 may be supported by the side supporting projection 200 and the bottom side of the rack 40 may be supported by the auxiliary supporting projection 400, as will be described below.

With this structure, noise reduction may be facilitated by the side supporting projection 200 and the bottom supporting projection 300 having a complicated shape may be omitted, thereby reducing the number of production processes and saving the cost.

Turning back to FIG. 6, at the projection 50, the auxiliary supporting projection 400 may be formed to support the bottom side of the rack 40 when the rack 40 is put on the projection 50. The auxiliary supporting projection 400 may be located between the bottom side of the rack 40 and the projection 50. The auxiliary supporting projection 400 may be formed from a protruding portion of the inner case 11 that forms the projection 50. Specifically, the auxiliary supporting projection 400 may be integrally formed with the projection 50 and the inner case 11.

The auxiliary supporting projection 400 may have the same height as the height of the bottom supporting projection 300. Accordingly, the rack 40 supported by the auxiliary supporting projection 400 and the bottom supporting projection 300 may maintain the horizontal balance.

The auxiliary supporting projection 400 may be shaped like a protrusion having the same width as that of the projection 50. The auxiliary supporting projection 400 may be rounded into a curved plane. Accordingly, the auxiliary supporting projection 400 may minimize an area of contact with the bottom side of the rack 40. The auxiliary supporting projection 400 may make point contact or line contact with the bottom side of the rack 40. It is not, however, limited thereto, and the auxiliary supporting projection 400 may have a curved plane having the same shape as the bottom supporting projection 300.

The auxiliary supporting projection 400 may minimize the noise for the same reason with the bottom supporting projection 300, may be easily produced because of having the simple form, and may distribute the weight of the rack 40 heavily loaded with foods with the bottom supporting projection 300.

On the projection 50, both the supporting projection 100 and the auxiliary supporting projection 400 may be formed. The auxiliary supporting projection 400 may be located in front of the supporting projection 100. It is not, however, limited thereto, and the auxiliary supporting projection 400 may be omitted.

The supporting projection 100 may have plane symmetry with a plane parallel to the rear side of the fridge chamber 21 and passing through the center of the supporting projection 100. Specifically, a line passing through the center of the side supporting projection 200 and a line passing through the center of the bottom supporting projection 300 cross at a right angle, and the two lines lie on a plane parallel to the rear side of the fridge chamber 21.

Figure 9:
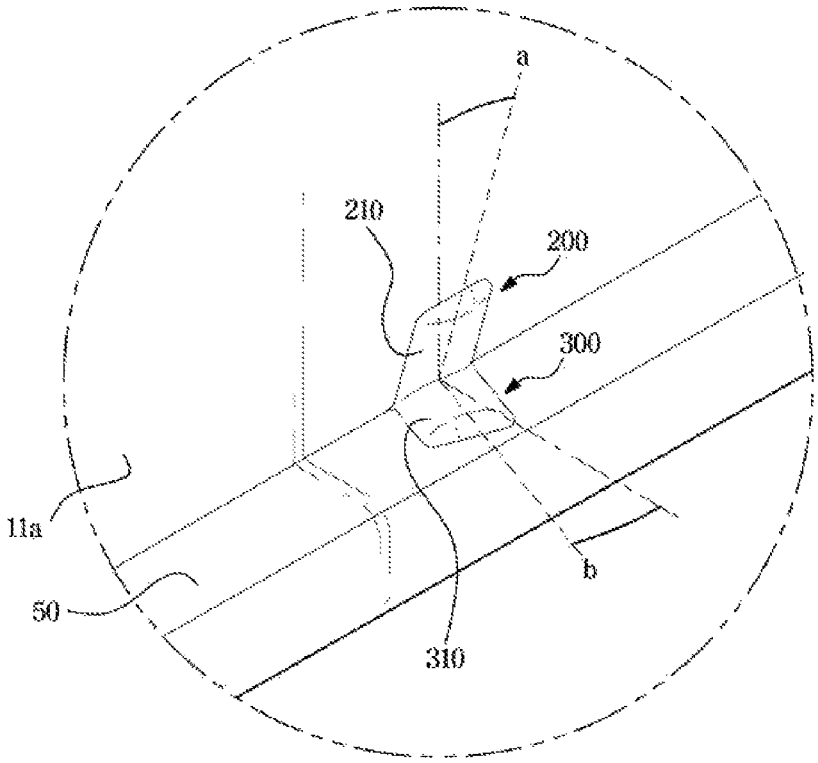
FIG. 9 shows a supporting projection of a refrigerator, according to another embodiment of the disclosure.

However, the embodiment of the disclosure is not limited thereto. FIG. 9 shows a supporting projection of a refrigerator, according to another embodiment of the disclosure.

Referring to FIG. 9, the supporting projection 100 may be asymmetric with respect to a plane parallel to the rear side of the fridge chamber 21. In other words, the rack contact portion 210 of the side supporting projection 200 and the rack contact portion 310 of the bottom supporting projection 300 may not be arranged on the same plane parallel to the rear side of the fridge chamber 21.

With respect to a straight line extending in the vertical direction of the fridge chamber 21 and crossing the projection 50 at a right angle, a center line a of the side supporting projection 200 may be tilted to the rear side of the fridge chamber 21. That is, an end of the side supporting projection 200 may lean toward the rear side of the fridge chamber 21 to be closest to the rear side of the fridge chamber 21.

Furthermore, with respect to a straight line perpendicular to the side of the fridge chamber 21, a center line b of the bottom supporting projection 300 may be tilted to the front of the fridge chamber 21. That is, an end of bottom side supporting projection 300 may lean toward the front of the fridge chamber 21 to be closest to the front of the fridge chamber 21.

It is not, however, limited thereto, and the center line a of the side supporting projection 200 may lean toward the front of the fridge chamber 21 and the center line b of the bottom supporting projection 300 may lean toward the rear side of the fridge chamber 21.

With the structure, when the rack 40 is put on the projections 50, the rack contact portion 210 of the side supporting projection 200 and the rack contact portion 310 of the bottom supporting projection 300 contact the rack 40 not simultaneously but one after another, so the movement of the rack 40 may be less interrupted and thus the rack 40 may be easily mounted on the projection 50.

Figure 10:
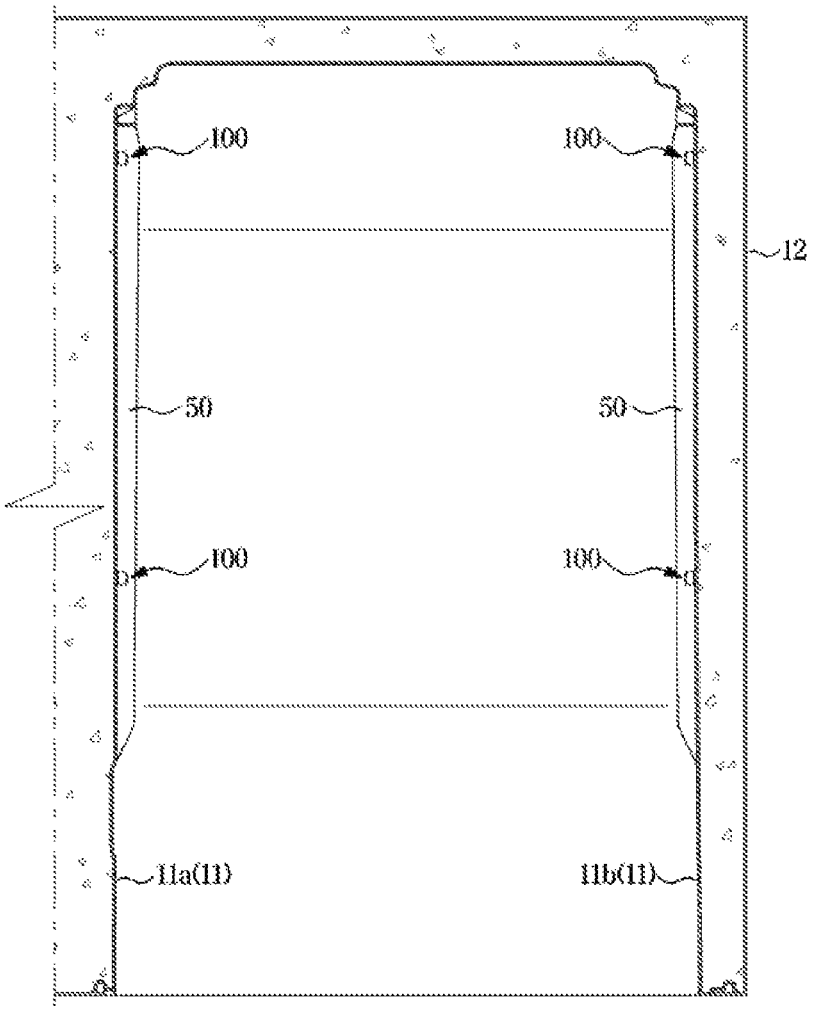
FIG. 10 is a top view of arrangement of the projection and the supporting projection of the refrigerator shown in FIG. 1.
Figure 11:
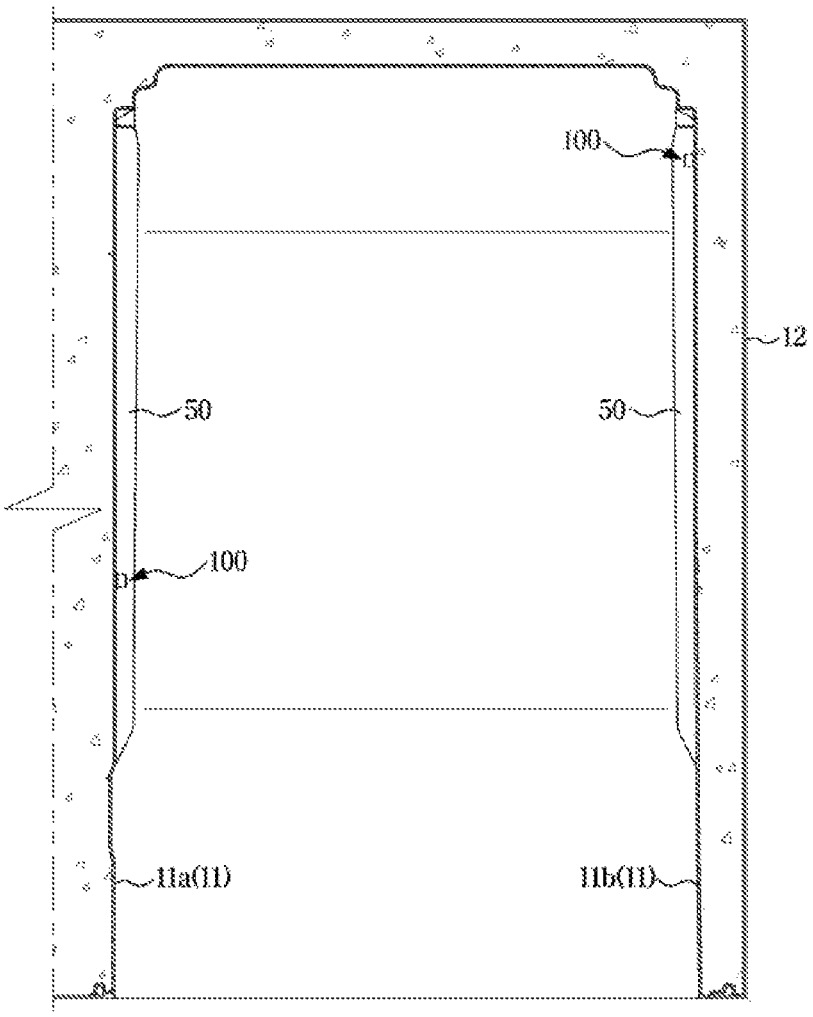
FIG. 11 is a top view of arrangement of a projection and a supporting projection of a refrigerator, according to another embodiment of the disclosure.

FIG. 10 is a top view of arrangement of the projection and the supporting projection of the refrigerator shown in FIG. 1. FIG. 11 is a top view of arrangement of a projection and a supporting projection of a refrigerator, according to another embodiment of the disclosure.

Referring to FIG. 10, the single rack 40 may be supported by four of the supporting projections 100. Specifically, there may be two of the supporting projections 100 arranged near the front of the fridge chamber 21 to support the left and right sides of the rack 40, and another two of the supporting projections 100 arranged near the rear side of the fridge chamber 21 to support the left and right sides of the rack 40.

The two supporting projections 100 arranged near the front of the fridge chamber 21 may face each other. Specifically, one of the supporting projection 100 formed on the left side 11*a* of the fridge chamber 21 and the other one formed on the right side 11*b* of the fridge chamber 21 may be paired together, and may lie on a plane parallel to the rear side of the fridge chamber 21. Likewise, the other two of the supporting projections 100 arranged near the rear side of the fridge chamber 21 may be paired together.

The arrangement is not, however, limited thereto. For example, although two pairs of the supporting projections 100 are shown in FIG. 10, there may be only one pair or three or more pairs of the supporting projections 100 arranged at the fridge chamber 21.

Furthermore, the projections are not limited to the supporting projections 100 as shown in FIG. 6, but the side supporting projections 200 as shown in FIG. 7, both the auxiliary supporting projections 400 and the side supporting projections 200 as shown in FIG. 8, or the supporting projections 100 as shown in FIG. 9 may be arranged in the same positions.

This four-point supporting may prevent left and right sides of the rack 40 near the front of the fridge chamber 21 and left and right sides of the rack 40 near the rear side of the fridge chamber 21 from colliding with the sides 11*a* and 11*b* of the fridge chamber 21 and making noise, and reliably support the rack 40.

It is not, however, limited thereto, and the single rack 40 may be supported by two of the supporting projections 100. Specifically, as shown in FIG. 11, one of the supporting projection 100 may be arranged near the front of the fridge chamber 21 to support one of the left and right sides of the rack 40, and the other one of the supporting projection 100 may be arranged near the rear side of the fridge chamber 21 to support the other one of the left and right sides of the rack 40. The two supporting projections 100 may be arranged to form a diagonal when the rack 40 is viewed from above the fridge chamber 21.

The projections are not limited to the supporting projections 100 as shown in FIG. 6, but the side supporting projections 200 as shown in FIG. 7, both the auxiliary supporting projections 400 and the side supporting projections 200 as shown in FIG. 8, or the supporting projections 100 as shown in FIG. 9 may be arranged in the same positions.

This arrangement of the two supporting projections 100 may prevent a front portion of the rack 40 from trembling to the left and right by using one of the supporting projections 100 and a rear portion of the rack 40 from trembling to the left and right by using the other one of the supporting projections 100, also making it easy to manufacture the product and saving the molding process cost because only the two supporting projections 100 are required.

According to the disclosure, a side supporting projection is provided in a refrigerator to support a side of a rack to prevent contact between the rack and the inner case of the refrigerator. Accordingly, noise created from collision between the side of the rack and the inside of a storeroom of the refrigerator may be reduced.

According to the disclosure, the rack in the refrigerator may be prevented from being out of position by preventing the rack from freely moving in a separation space between the side of the rack and the inner case.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

an outer case;

an inner case arranged inside the outer case to define a storeroom;

a rack arranged in the storeroom, the rack being removable from the storeroom;

a projection formed to protrude from a side of the inner case to support a side end of the rack, the projection being integrally formed with the inner case;

at least one side supporting projection formed to protrude from the side of the inner case to thereby form a first separation space between the side of the inner case and the side end of the rack while the side end of the rack is being supported by the projection; and a bottom supporting projection formed at the projection to form a second separation space between the projection and a bottom side of the rack, wherein the at least one side supporting projection comprises:

a first rack contact portion arranged between the side end of the rack and the side of the inner case and formed into a curved plane to reduce an area of contact with the side end of the rack, and wherein the bottom supporting projection comprises a second rack contact portion arranged between the bottom side of the rack and the projection and formed into a curved plane to reduce an area of contact with the bottom side of the rack.

2. The refrigerator of claim 1, wherein the at least one side supporting projection is formed on the side of the inner case, wherein the bottom supporting projection is formed on the projection, and wherein the at least one side supporting projection and the bottom supporting projection are integrally formed.

3. The refrigerator of claim 2, further comprising:

an auxiliary supporting projection formed on the projection to support the bottom side of the rack and arranged in front of the bottom supporting projection.

4. The refrigerator of claim 2, wherein the bottom supporting projection is formed to be tilted toward a front of the storeroom such that an end of the bottom supporting projection is closest to the front of the storeroom, and the at least one side supporting projection is formed to be tilted toward a rear side of the storeroom such that an end of the at least one side supporting projection is closest to the rear side of the storeroom.

5. The refrigerator of claim 2, wherein the at least one side supporting projection is integrally formed with the inner case, and wherein the bottom supporting projection is integrally formed with the projection.

6. The refrigerator of claim 1, wherein the projection comprises a first projection arranged on a left side of the inner case, on which a left end of the rack is to be supported, and a second projection arranged on a right side of the inner case, on which a right end of the rack is to be supported at a height corresponding to the first projection, and wherein the at least one side supporting projection is a first side supporting projection formed on the left side of the inner case, and a second side supporting projection is formed on the right side of the inner case at a height corresponding to the first side supporting projection.

7. The refrigerator of claim 6, wherein the first side supporting projection and the second side supporting projection are arranged to face each other.

8. The refrigerator of claim 7, further comprising:

a first bottom supporting projection formed at the first projection to form a separation space between the first projection and the bottom side of the rack, and a second bottom supporting projection formed at the second projection to form another separation space between the second projection and the bottom side of the rack.

9. The refrigerator of claim 8, wherein the first side supporting projection and the first bottom supporting projection are integrally formed, and the second side supporting projection and the second bottom supporting projection are integrally formed.

10. The refrigerator of claim 6, wherein one of the first side supporting projection and the second side supporting projection is arranged near the front of the inner case, and another one of the first side supporting projection and the second side supporting projection is arranged near the rear side of the inner case.

11. The refrigerator of claim 10, further comprising:

a first bottom supporting projection formed at the first projection to form a separation space between the first projection and the bottom side of the rack, and a second bottom supporting projection formed at the second projection to form another separation space between the second projection and the bottom side of the rack.

12. The refrigerator of claim 11, wherein the first side supporting projection and the first bottom supporting projection are integrally formed, and the second side supporting projection and the second bottom supporting projection are integrally formed.

13. A refrigerator comprising:

an outer case;

an inner case arranged inside the outer case to define a storeroom;

a rack arranged in the storeroom, the rack being removable from the storeroom;

a first projection formed on a left side of the inner case to allow the rack to be supported on the first projection, the first projection having a plurality of first bottom supporting projections arranged to contact a bottom side of the rack;

a second projection formed on a right side of the inner case, the second projection having a plurality of second bottom supporting projections arranged to contact the bottom side of the rack;

a first side supporting projection formed on the left side of the inner case to come into contact with a left side of the rack while the left side of the rack is supported on the first projection, the first side supporting projection having a first curved plane to reduce a first area of contact with the rack; and a second side supporting projection formed on the right side of the inner case to come into contact with a right side of the rack while the right side of the rack is supported on the second projection, the second side supporting projection having a second curved plane to reduce a second area of contact with the rack.

14. The refrigerator of claim 13, wherein one of the first side supporting projection and the second side supporting projection is arranged near a front of the inner case, and another one of the first side supporting projection and the second side supporting projection is arranged near a rear side of the inner case.

15. The refrigerator of claim 14, further comprising:

a third side supporting projection formed on the left side of the inner case, and a fourth side supporting projection formed on the right side of the inner case, wherein the third side supporting projection is arranged to face the second side supporting projection, and the fourth side supporting projection is arranged to face the first side supporting projection.

16. The refrigerator of claim 13, wherein the plurality of first bottom supporting projections and the plurality of second bottom supporting projections are connected to and formed integrally with the plurality of first side supporting projection and the plurality of second side supporting projection, respectively.

17. A refrigerator comprising:

an outer case;

an inner case arranged inside the outer case to define a storeroom;

a rack arranged in the storeroom, the rack being removable from the storeroom;

a plurality of projections formed to protrude from an inner side of the inner case for the rack to be arranged in the storeroom; and a supporting projection formed on an edge of each of the plurality of projections to support a side end of the rack, wherein the supporting projection comprises:

a first rack contact portion contacting a side of the rack and formed into a first curved plane to reduce a first area of contact with the side of the rack, and a second rack contact portion contacting a bottom side of the rack and formed into a second curved plane to reduce a second area of contact with the bottom side of the rack.

18. The refrigerator of claim 17, wherein the supporting projection is formed by integrally connecting a side supporting projection having the first rack contact portion arranged, and connected to the inner case, to a bottom supporting projection having the second rack contact portion arranged, and connected to the projection case are integrally connected.

* * * * *